US011544991B2

(12) United States Patent
Meyer

(10) Patent No.: US 11,544,991 B2
(45) **Date of Patent: *Jan. 3, 2023**

(54) GAMING DEVICE AND METHOD FOR OPERATING A GAMING DEVICE

(71) Applicant: Aristocrat Technologies Australia Pty Limited, North Ryde (AU)

(72) Inventor: Jason Meyer, Wyoming (AU)

(73) Assignee: Aristocrat Technologies Australia PTY Limited, North Ryde (AU)

( * ) Notice: Subject to any disclaimer, the term of this patent is extended or adjusted under 35 U.S.C. 154(b) by 29 days.

This patent is subject to a terminal disclaimer.

(21) Appl. No.: 17/366,307

(22) Filed: Jul. 2, 2021

(65) Prior Publication Data

US 2021/0335090 A1 Oct. 28, 2021

Related U.S. Application Data

(63) Continuation of application No. 16/538,623, filed on Aug. 12, 2019, now Pat. No. 11,087,585.

(30) Foreign Application Priority Data

Aug. 13, 2018 (AU) ..... 2018902949
Jun. 14, 2019 (AU) ..... 2019204175

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/34* (2013.01)

(58) Field of Classification Search
CPC ... G07F 17/3213; G07F 17/3209; G07F 17/34
(Continued)

(56) References Cited

U.S. PATENT DOCUMENTS 5,833,537 A 11/1998 Barrie
5,935,002 A 8/1999 Falciglia
(Continued)

FOREIGN PATENT DOCUMENTS

AU 2019204175 2/2020

OTHER PUBLICATIONS

Office Action (Non-Final Rejection) dated Dec. 22, 2021 for U.S. Appl. No. 16/950,000 (pp. 1-16).
(Continued)

*Primary Examiner* — Michael A Cuff
(74) *Attorney, Agent, or Firm* — Brownstein Hyatt Farber Schreck, LLP

(57) ABSTRACT

A method of operating a gaming device, comprising: displaying an arrangement of a predetermined number of symbol windows; receiving a selection of a number of the windows equal to the unique selection number and causing the display to present a graphical indication of the selected windows; undertaking play of a game, wherein as a result of the base game, each window is associated with a symbol, and wherein each symbol is displayed on the touchscreen display within its associated window, and wherein each symbol is randomly selected from a set comprising one or more first symbols and one or more second symbols; determining that one or more of the selected windows comprises a first symbol as a result of play of the base game; and awarding an award in accordance with the number of selected windows comprising first symbols and an award rule associated with the selected number of windows.

20 Claims, 12 Drawing Sheets

(58) Field of Classification Search
USPC ..... 463/16–20
See application file for complete search history.

(56) References Cited

U.S. PATENT DOCUMENTS

| | | | |
|---|---|---|---|
| 7,237,775 | B2 | 7/2007 | Thomas |
| 7,445,547 | B2 | 11/2008 | Suzuki |
| 7,780,519 | B2 | 8/2010 | Gomez |
| 8,172,665 | B2 | 5/2012 | Hoffman |
| 8,226,468 | B2 | 7/2012 | Hoffman |
| 8,371,928 | B2 | 2/2013 | Englman |
| 8,388,438 | B2 | 3/2013 | Englman |
| 8,460,092 | B1 | 6/2013 | Slomiany |
| 8,591,308 | B2 | 11/2013 | Hoffman |
| 9,135,785 | B2 | 9/2015 | Hoffman |
| 9,449,470 | B2 | 9/2016 | Baerlocher |
| 9,530,287 | B2 | 12/2016 | Hoffman |
| 9,564,006 | B2 | 2/2017 | Ryan |
| 9,600,979 | B2 | 3/2017 | Hornik |
| 9,640,025 | B2 | 5/2017 | Saunders |
| 9,691,231 | B2 | 6/2017 | Fujisawa |
| 9,824,527 | B2 | 11/2017 | Evans |
| 9,836,915 | B2 | 12/2017 | Meyer |
| 9,940,775 | B2 | 4/2018 | Eaton |
| 10,152,845 | B2 | 12/2018 | Pawloski |
| 10,388,112 | B2 | 8/2019 | You |
| 10,403,093 | B1 | 9/2019 | Halvorson |
| 10,410,477 | B2 | 9/2019 | Hoffman |
| 2003/0022712 | A1 | 1/2003 | Locke |
| 2003/0092480 | A1* | 5/2003 | White ..... G07F 17/3265 463/20 |
| 2003/0092487 | A1 | 5/2003 | Meyer |
| 2004/0033827 | A1 | 2/2004 | Gilmore |
| 2004/0048646 | A1 | 3/2004 | Visocnik |
| 2004/0053676 | A1 | 3/2004 | Rodgers |
| 2005/0059459 | A1 | 3/2005 | Dunn |
| 2006/0189380 | A1 | 8/2006 | Schultz |
| 2007/0026923 | A1 | 2/2007 | Muir |
| 2007/0060265 | A1 | 3/2007 | Marks |
| 2007/0238510 | A1 | 10/2007 | Halprin |
| 2008/0242404 | A1 | 10/2008 | Aoki |
| 2009/0325681 | A1 | 12/2009 | Englman |
| 2010/0298041 | A1 | 11/2010 | Berman |
| 2011/0045894 | A1 | 2/2011 | Owen |
| 2011/0124405 | A1 | 5/2011 | Okada |
| 2012/0202570 | A1 | 8/2012 | Schwartz |
| 2014/0274284 | A1 | 9/2014 | Leupp |
| 2015/0018070 | A1 | 1/2015 | Meyer |
| 2015/0024826 | A1 | 1/2015 | Ghaly |
| 2015/0087382 | A1 | 3/2015 | Gilbertson |
| 2015/0087385 | A1 | 3/2015 | Shiraishi |
| 2015/0094132 | A1 | 4/2015 | Elias |
| 2015/0213672 | A1 | 7/2015 | Elias |
| 2015/0339889 | A1 | 11/2015 | Oropeza |
| 2015/0363999 | A1 | 12/2015 | Little |
| 2016/0093150 | A1 | 3/2016 | Penacho |
| 2016/0203670 | A1 | 7/2016 | Ford |
| 2016/0247361 | A1 | 8/2016 | Meyer |
| 2017/0011582 | A1 | 1/2017 | Fong |
| 2018/0025585 | A1 | 1/2018 | Schmidt |
| 2018/0061176 | A1 | 3/2018 | Berman |
| 2018/0130286 | A1 | 5/2018 | Berman |
| 2018/0268659 | A1 | 9/2018 | Chesworth |
| 2019/0139371 | A1 | 5/2019 | Lamb |
| 2019/0206191 | A1 | 7/2019 | Halvorson |
| 2019/0287336 | A1 | 9/2019 | Prabhu |
| 2019/0304255 | A1 | 10/2019 | San |
| 2020/0051373 | A1 | 2/2020 | Meyer |
| 2020/0111291 | A1 | 4/2020 | Pariseau |
| 2020/0168053 | A1 | 5/2020 | Berman |

OTHER PUBLICATIONS

Aristocrat, Welcome to Fantastic Jackpots—Fantastic Cash, https://www.aristocrat.com/anz/games/welcome-to-fantastic-jackpots-fantastic-cash/, Aug. 2018.
Notice of Allowance dated Apr. 5, 2021 for U.S. Appl. No. 16/538,623 (pp. 1-9).
Notice of Allowance dated Aug. 31, 2021 for U.S. Appl. No. 16/948,606 (pp. 1-9).
Office Action dated Sep. 13, 2021 for U.S. Appl. No. 16/948,607 (pp. 1-16).
Notice of Allowance dated Oct. 27, 2021 for U.S. Appl. No. 16/948,606 (pp. 1-8).
Office Action dated Aug. 12, 2021 for U.S. Appl. No. 16/948,308 (pp. 1-17).
Office Action dated Jan. 13, 2022 for U.S. Appl. No. 16/948,308 (pp. 1-6).
Office Action (Non-Final Rejection) dated Mar. 24, 2022 for U.S. Appl. No. 16/948,309 (pp. 1-24).
Office Action (Notice of Allowance and Fees Due (PTOL-85)) dated Jun. 7, 2022 for U.S. Appl. No. 16/948,308 (pp. 1-8).
Office Action (Final Rejection) dated Jul. 5, 2022 for U.S. Appl. No. 16/950,000 (pp. 1-15).
Notice of Allowance dated Feb. 9, 2022 for U.S. Appl. No. 16/948,606 (pp. 1-2).
Notice of Allowance dated Feb. 23, 2022 for U.S. Appl. No. 16/948,607 (pp. 1-9).
Office Action (Notice of Allowance and Fees Due (PTOL-85)) dated Sep. 27, 2022 for U.S. Appl. No. 16/948,308 (pp. 1-8).
Office Action (Final Rejection) dated Oct. 26, 2022 for U.S. Appl. No. 16/948,309 (pp. 1-23).

* cited by examiner

GAMING DEVICE AND METHOD FOR OPERATING A GAMING DEVICE

CROSS-REFERENCE TO RELATED APPLICATIONS

This application is a continuation of U.S. patent application Ser. No. 16/538,623, entitled "A GAMING DEVICE AND METHOD FOR OPERATING A GAMING DEVICE," filed Aug. 12, 2019, which claims priority to AU Patent Application No. 2019204175, entitled "A GAMING DEVICE AND METHOD FOR OPERATING A GAMING DEVICE," filed Jun. 14, 2019, and which also claims priority to AU Patent Application No. 2018902949, entitled "A GAMING DEVICE AND METHOD FOR OPERATING A GAMING DEVICE," filed Aug. 13, 2018, all of which are incorporated herein by reference.

FIELD

The present application relates to a gaming device and a method for operating a gaming device

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary features or bonus rounds (sometimes referred to as secondary game(s), although they are considered to be part of a single game instance) by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are useful to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

Some embodiments of the disclosed technology provide Cash-on-Reel games where the player is enabled to select a desired volatility of the game by choosing a number of Cash-on-Reel windows with a consequential effect on the resulting prize. The player may also be provided an opportunity to choose which windows will correspond to the Cash-on-Reel windows.

According to one aspect of the disclosed technology, there is provided a method of operating a gaming device, comprising: controlling a display to display an arrangement of a predetermined number of windows; receiving a selection of a number of the windows from among multiple selection options, wherein two or more of the selection options offer different numbers of windows and different award rules dependent on the associated number of windows, and wherein the selected windows are to be displayed with one or more graphical indications on the display; causing play of a game, wherein as a result of base game, each window is associated with a symbol, and wherein each symbol is displayed on the display within the respective symbol's associated window, and wherein each symbol is selected randomly from a set comprising one or more first symbols and one or more second symbols, wherein the one or more second symbols do not alone trigger an award; determining whether one or more of the selected windows comprises a first symbol as a result of play of the base game; and in response, awarding an award in accordance with the number of selected windows comprising first symbols and the award rule associated with the selected number of windows.

According to another aspect of the disclosed technology, there is provided a method of operating a gaming device, comprising the steps of: causing a touchscreen display of the gaming device to display an arrangement of a predetermined number of symbol positions; receiving, via the touchscreen display, a selection of a number of the windows equal to a unique selection number and causing the display to present a graphical indication of the selected windows; undertaking play of a game, wherein as a result of the base game, each window is associated with a symbol, and wherein each symbol is displayed on the touchscreen display within its associated window, and wherein each symbol is randomly selected from a set comprising one or more first symbols (for example, the, or each, first symbol corresponds to a cash-on-reel symbol) and one or more second symbols; determining that one or more of the selected windows comprises a first symbol (e.g., a COR symbol on any of the one or more selected windows) as a result of play of the base game; and awarding an award in accordance with the number of selected windows comprising first symbols and the award rule associated with the selected configuration option.

According to another aspect of the disclosed technology, there is provided a gaming device comprising: an electronic touchscreen display; a processor; and a memory storing instructions which when executed by the processor cause the processor to: control the display to display an arrangement of a predetermined number of windows; receive, via the touchscreen display, a selection of a number of the windows equal to a unique selection number and present on the display a graphical indication of the selected windows; undertake play of a game, wherein as a result of base game, each window is associated with a symbol, and wherein each symbol is displayed on the touchscreen display within its associated window, and wherein each symbol is selected randomly from a set comprising one or more first symbols (for example, the, or each, first symbol corresponds to a Cash-on-Reel symbol) and one or more second symbols; determine whether one or more of the selected windows comprises a first symbol as a result of play of the base game; and in response, award an award in accordance with the number of selected windows comprising first symbols and the award rule associated with the selected configuration option.

According to another aspect of the disclosed technology, there is provided a method of operating a gaming device, comprising the steps of: causing a touchscreen display of the gaming device to display an arrangement of a predetermined number of windows; receiving a selection of one of a plurality of configuration options, each configuration option associated with a unique number of game rounds and a unique selection number; determining a selection of a number of the windows equal to the unique selection number and presenting a graphical indication of the selected windows; undertaking play of a spinning reel game a number of times equal to the number of game rounds associated with the selected configuration option, wherein each play of the spinning reel game results in each window being associated with a symbol, wherein each symbol is displayed on the touchscreen display within its associated window, wherein each symbol is selected randomly from a set comprising one or more first symbols (for example, the, or each, first symbol corresponds to a Cash-on-Reel symbol) and one or more second symbols, wherein an award is awarded after each game round if one or more of the selected windows comprises a first symbol.

According to another aspect of the disclosed technology, there is provided a method of operating a gaming device, comprising the steps of: undertaking play of a base game; determining that a bonus game trigger event has occurred as result of play of the base game; and undertaking play of a bonus game in accordance with the method of the above aspect.

According to yet another aspect of the disclosed technology, there is provided a gaming device comprising: an electronic touchscreen display; a processor; and a memory storing instructions which when executed by the processor cause the processor to: control a touchscreen display to display an arrangement of a predetermined number of windows; receive a selection of one of a plurality of configuration options, each configuration option associated with a unique number of game rounds and a unique selection number; determine a selection of a number of the windows equal to the unique selection number and presenting a graphical indication of the selected windows; undertake play of a spinning reel game a number of times equal to the number of game rounds associated with the selected configuration option, wherein each play of the spinning reel game results in each window being associated with a symbol, wherein each symbol is displayed on the touchscreen display within its associated window, wherein each symbol is selected randomly from a set comprising one or more first symbols (for example, the, or each, first symbol corresponds to a cash-on-reel symbol) and one or more second symbols, wherein an award is awarded after each game round if one or more of the selected windows comprises a first symbol.

According to still yet another aspect of the disclosed technology, there is provided a gaming device comprising: an electronic touchscreen display; a processor; and a memory storing instructions which when executed by the processor cause the processor to: cause the processor to implement play of a base game; determine that a bonus game trigger event has occurred as result of play of the base game; and in response, control play of a bonus game by causing the processor to: control a touchscreen display to display an arrangement of a predetermined number of windows; receive a selection of one of a plurality of configuration options, each configuration option associated with a unique number of game rounds and a unique selection number; determine a selection of a number of the windows equal to the unique selection number and presenting a graphical indication of the selected windows; undertake play of a spinning reel game a number of times equal to the number of game rounds associated with the selected configuration option, wherein each play of the spinning reel game results in each window being associated with a symbol, wherein each symbol is displayed on the touchscreen display within its associated window, wherein each symbol is selected randomly from a set comprising one or more first symbols (for example, the, or each, first symbol corresponds to a cash-on-reel symbol) and one or more second symbols, wherein an award is awarded after each game round if one or more of the selected windows comprises a first symbol.

DETAILED DESCRIPTION

The detailed description presents innovations in user interface ("UI") features of electronic gaming devices, as well as innovations in features of back-end processing to implement the UI features. For example, processes for electronic gaming machines ("EGMs") that present the user to select one or more symbol window spots are described. In some embodiments, for instance, the options offer a user an opportunity to choose either more windows for a "Cash-on-Symbol" ("COS") symbol with a lower payout, or fewer COS symbol spots with a greater (and, in some examples, dynamic) multiplier. The disclosed technology also describes one or more intermediate selections that can also be selected. As a result, the disclosed technology provides numerous innovations that provide the user with several game play options that varies the desired game volatility while maintaining the same designated RTP (e.g., as may be required by jurisdictional regulations).

Figure 1:
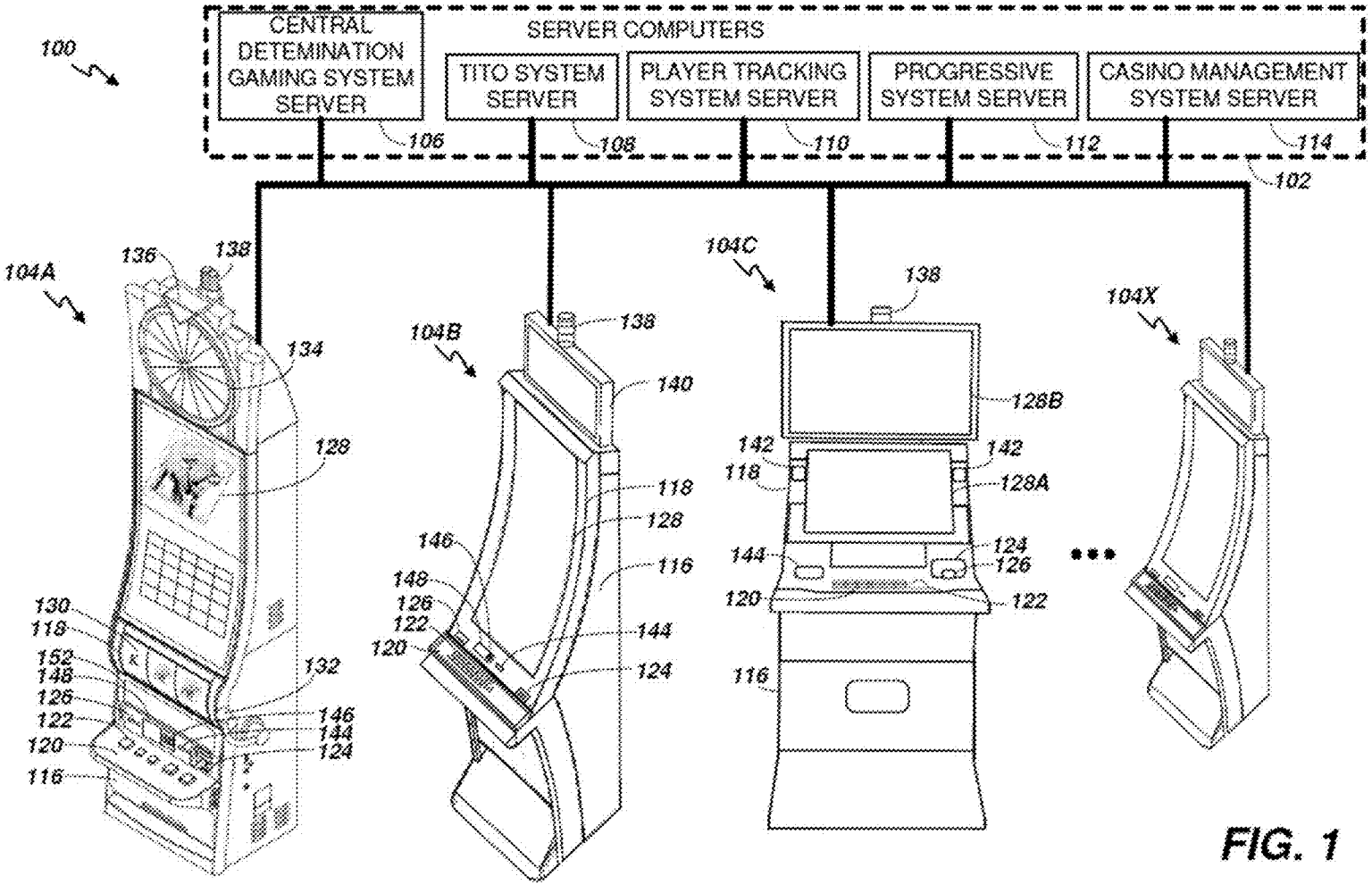
FIG. 1 is an exemplary diagram showing several EGMs networked with various gaming related servers.

FIG. 1 illustrates several different models of EGMs which may be networked to various gaming related servers. The disclosed technology can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the disclosed technology may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out ("TITO") system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
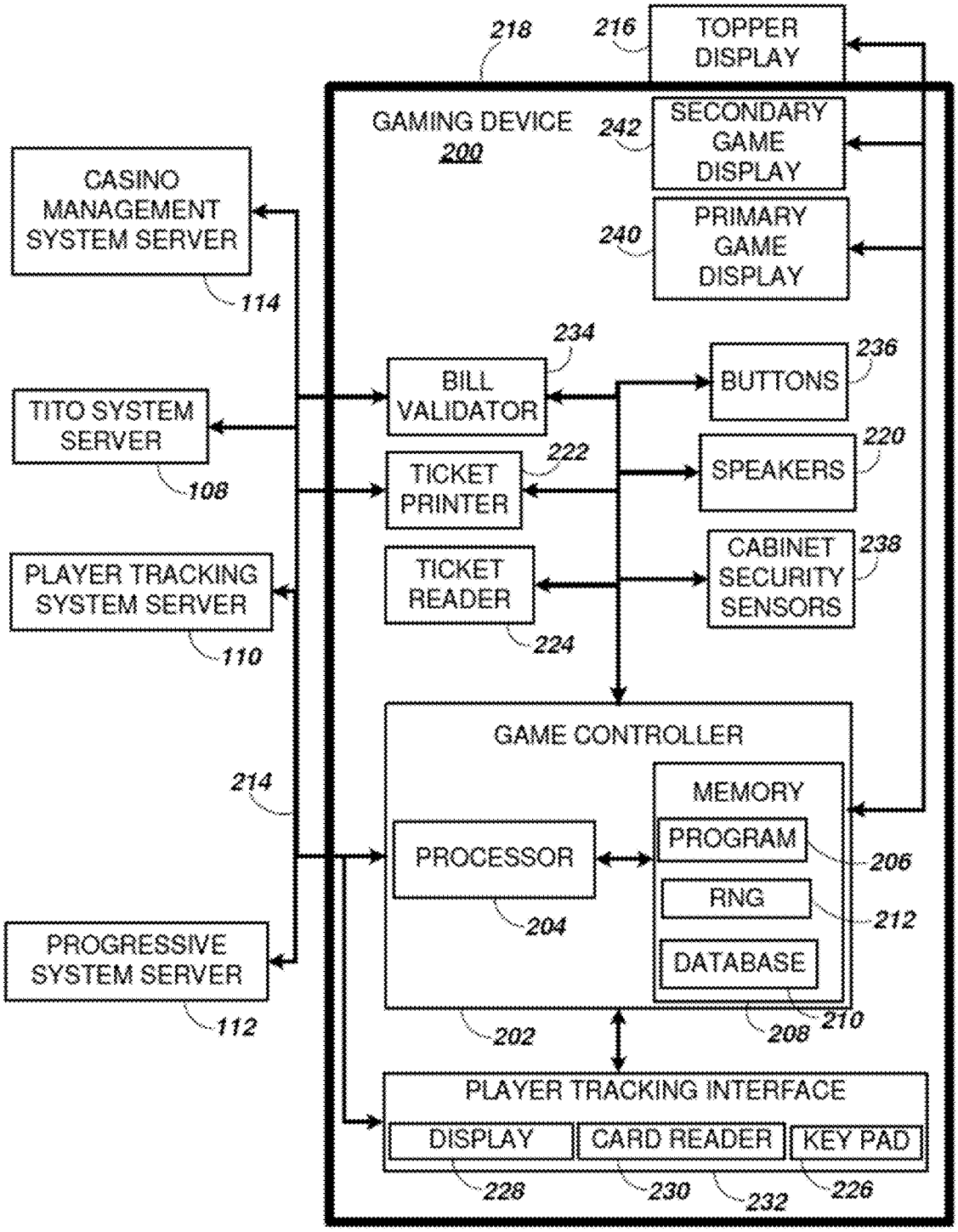
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the disclosed technology necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: (a) the regulatory requirements for gaming devices 200, (b) the harsh environment in which gaming devices 200 operate, (c) security requirements, (d) fault tolerance requirements, and (e) the requirement for additional special purpose componentry enabling functionality of an EGM. These differences require substantial engineering effort with respect to game design implementation, hardware components and software.

One regulatory requirement for games running on gaming device 200 generally involves complying with a certain level of randomness (e.g., that outcomes will be statistically independent, uniformly distributed over their range, unpredictable and pass statistical tests such as chi-square test, equi-distribution test, gap test, runs test, serial correlation test, etc.). Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG 212 can be integrated into the game controller 202 or processor 204. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. (Gaming regulations may require that each reel outcome be independent of each other reel outcome, such that no reel outcome depends on any other reel outcome.) In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%).

A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

To meet a designated RTP, a game developer can utilize one or more lookup tables (e.g., weighted tables) to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
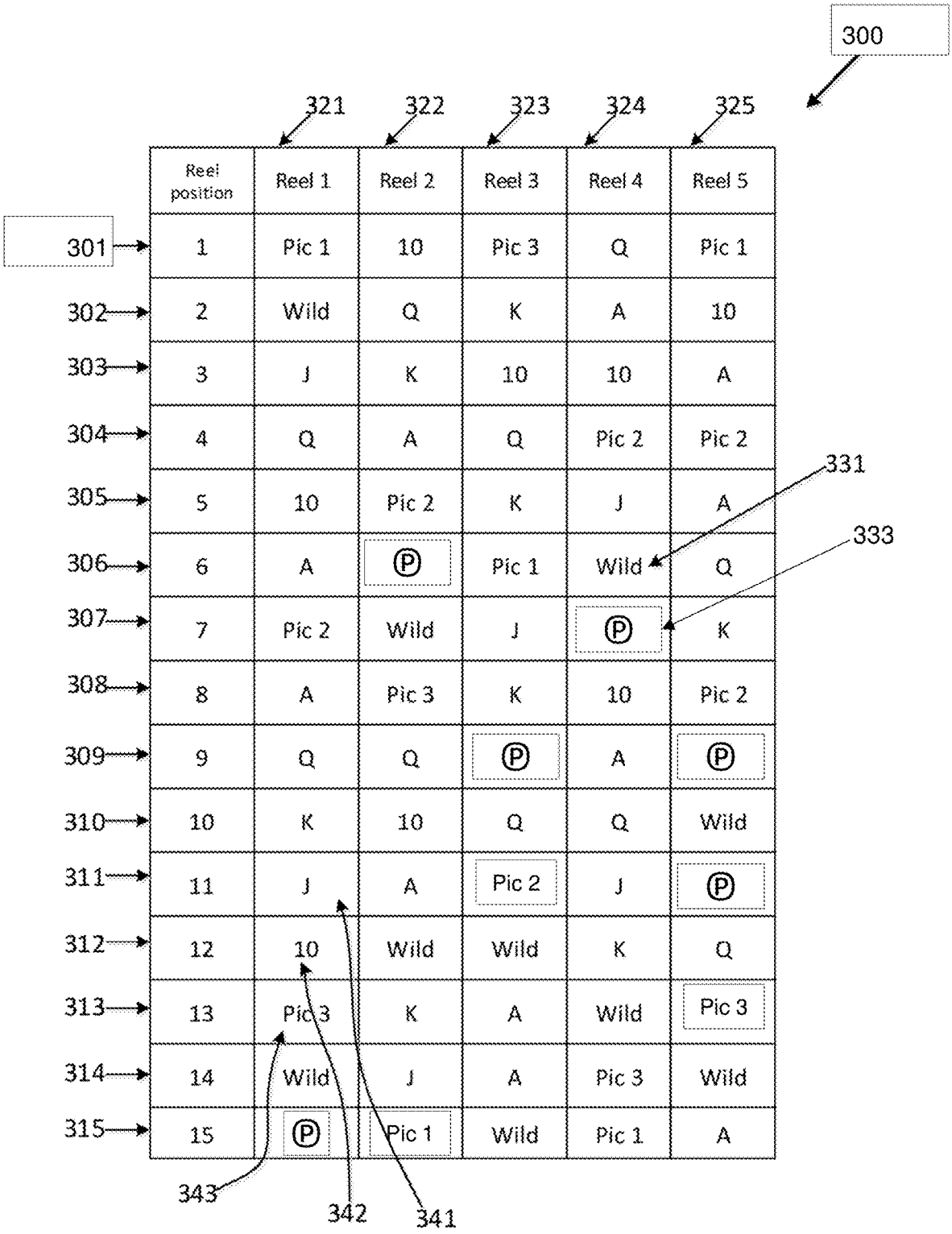
FIG. 3 illustrates an example reel strip layout.

FIG. 3 illustrates an example of a set 300 of five reel strips 321, 322, 323, 324, 325. In the example, each reel strip has fifteen reel strip positions 301-315. Each reel strip position of each reel has a symbol. For example, a "Wild" symbol 331 occupies the sixth reel strip position 306 of the fourth reel 324. It should be understood that reel strips other than those illustrated in FIG. 3 can be used. For example, reel strips where two or more wild symbols are placed at consecutive reel strip positions of a reel strip can be used. In other examples, the reel strips could have between 30 and 100 reel strip positions. The actual length of the feature game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

As another example, a cash-on-reel (COR) symbol 333 occupies the 7-th reel strip position of the 4-th reel. The COR symbol is a special symbol (e.g., a "Pearl" symbol, designated here as an encircled "P") with a processor-configurable prize amount P (e.g. $100 or a progressive prize such as a major jackpot) indicated on the special symbol. The processor-configurable cash amount is configured based on a random selection (e.g., from a range of discrete prize amounts, such as every $20 multiples from $20 to $200) and/or based on the player-selected denomination (e.g., higher cash amounts at higher denominations). In one example embodiment, each reel strip 321-325 comprises at least one COR symbol.

Figure 4:
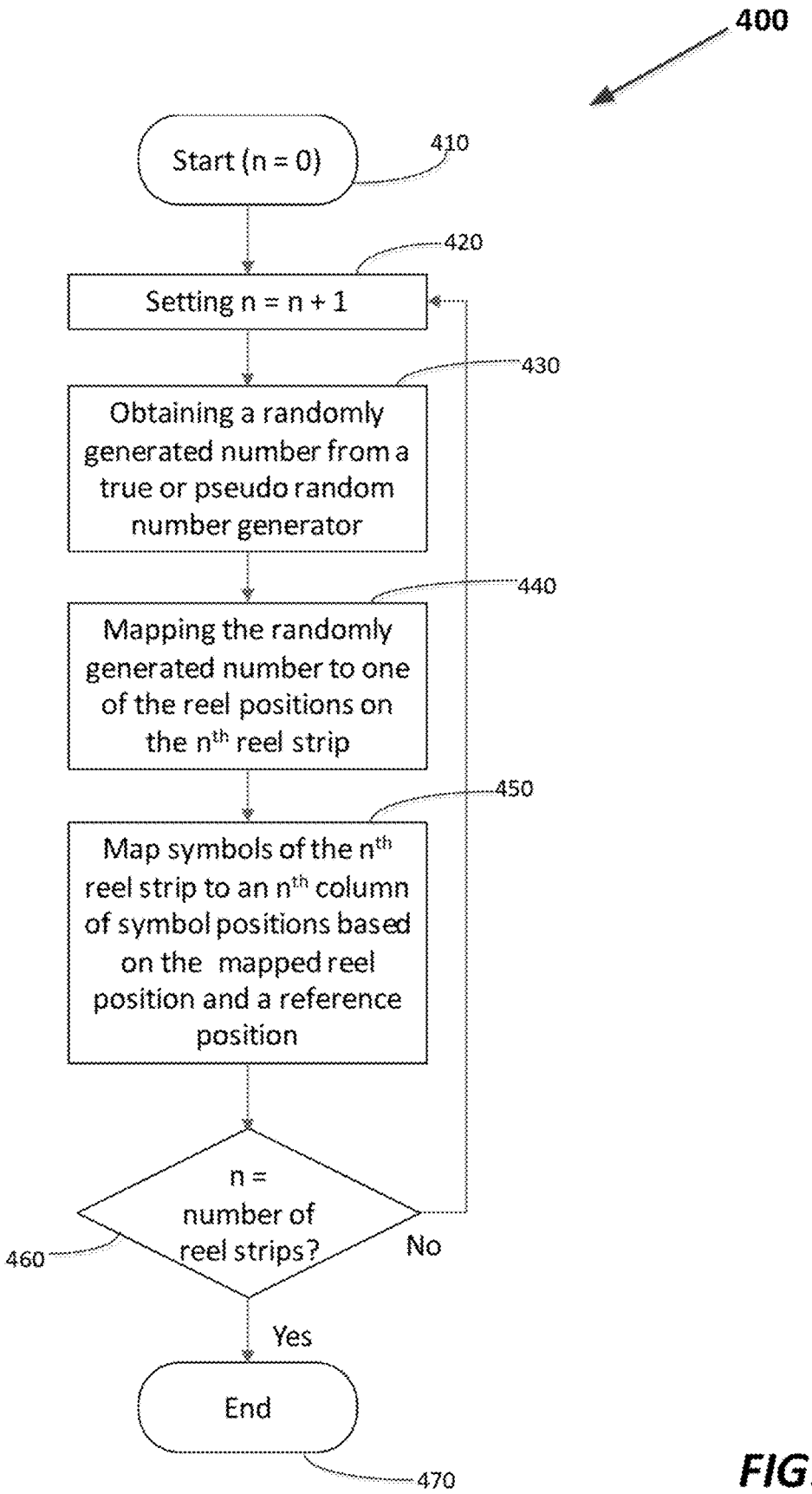
FIG. 4 is a flow chart of a symbol selection method.

FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430 the processor obtains a randomly generated number from a true or pseudo random number generator 212. At step 440 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a lookup table. In one example, the ranges are each the same size so that each of the reel strip positions has the same chance of been selected. In other examples, the ranges may be arranged to weight the relative chances of selecting specific reel strip positions. The reel strips may be of different lengths.

At step 450, the processor 204 maps symbols of the nth reel strip to an nth column of symbol positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighboring reel strip positions are also mapped to the symbol positions of the column. Referring to the example reel strips of FIG. 3, if the value returned by the RNG 212 is mapped to reel position 313, then for the first reel strip 321, "Pic3" symbol 343 is mapped to a bottom symbol position, "10" symbol 342 is mapped to a middle symbol position, and "J" symbol 341 is mapped to a top symbol position.

At step 460, the processor 460 determines whether symbols have been selected for all of the reel strips, and if not the processor reverts to step 420 and iterates through steps 430, 440 and 450 until it is determined at step 460 that symbols have been selected from all n reel strips and mapped to all n columns of symbol positions after which the symbol selection process ends 470. Different numbers of symbols may be mapped to different numbers of symbol positions.

After the symbols of all reel strips have been mapped to symbol position, the processor 204 controls display 240 to display them at the symbol positions.

Figure 5:
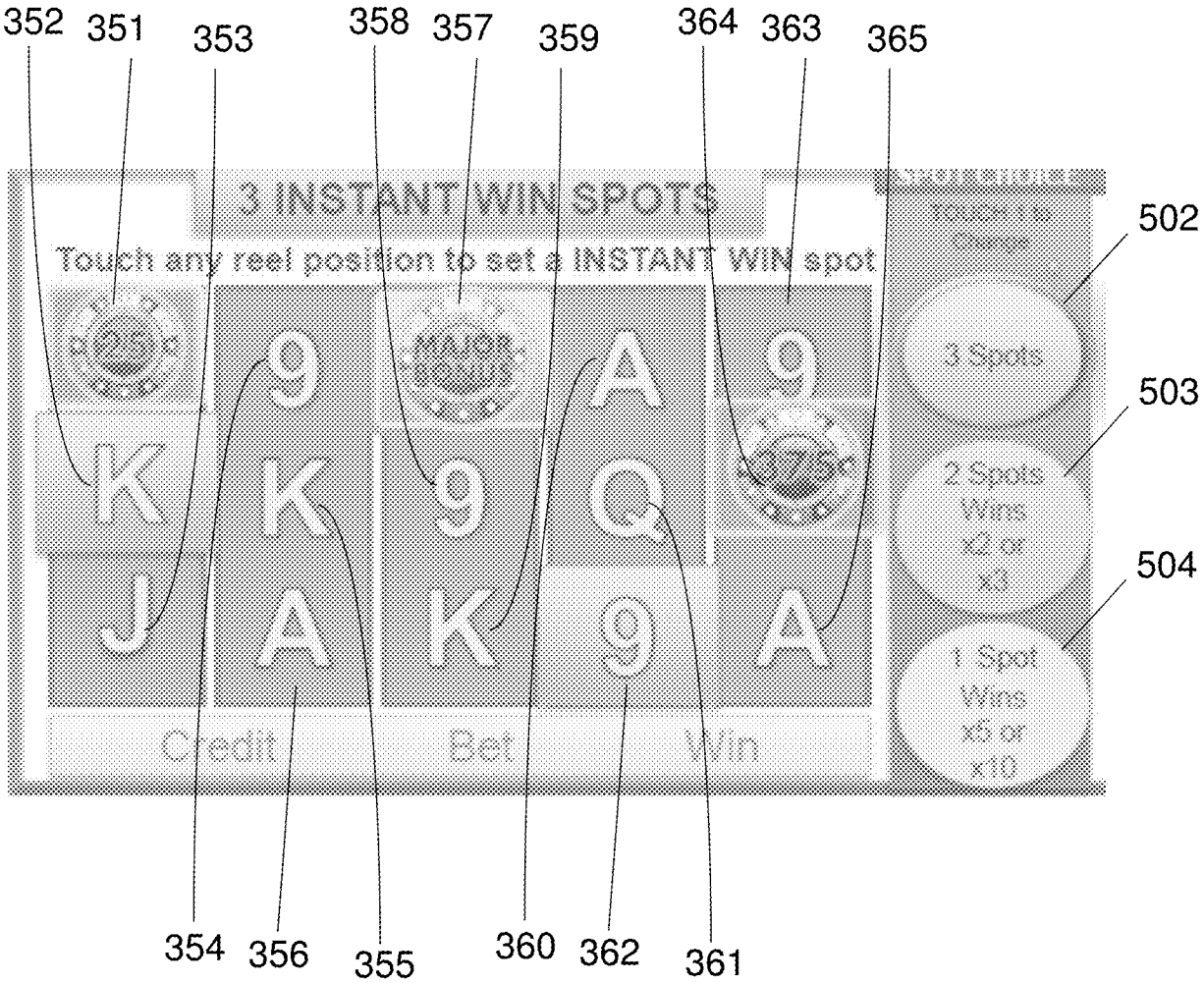
FIG. 5 shows a Cash-on-Reel base game according to an embodiment.

Referring to FIG. 5, a COR base game is shown on the primary game display 240. The COR base game comprises a reel game. The reel game includes five reel strips 321-325 (see FIG. 3). Selected symbols from each reel strip 321-325 are displayed in associated symbol positions 351-365. The symbol positions 351-365 are arranged into three rows and five columns, as shown. Each of the symbol positions 351-365 corresponds to a symbol display position, such that, after play of a game of the underlying reel game 500, each of the symbol positions 351-365 comprises a symbol selected from the five reel strips 321-325, or a symbol adjacent to a selected symbol on the reel strips 321-32 (see, for example, the method of FIG. 4). It should be understood by those skilled in the art that the term "symbol position" is used to refer to the particular position in the designated display arrangement (here, three rows and five columns) in which a symbol of the reel strips is displayed to the player. That arrangement can be varied in numerous manners by altering the number of rows and/or columns, as the game designer desires.

Again, the embodiments described herein are illustrative, as the number of reel strips 321-325 and/or the number of symbol positions 351-365 can be varied as required. Generally, an award may be presented due to the selection and arrangement of symbols in the reel game 500.

In accordance with certain embodiments of the disclosed technology, the COR base game is configured before play of the base reel game. In the example of FIG. 5, the player is presented with three configuration options for selection: "3 SPOTS" indicated by button 502 (option 1); "2 SPOTS" indicated by button 503 (option 2); and "1 SPOT" indicated by button 504 (option 3). Option 1 is associated with a non-multiplier payout (or, equivalently, a multiplier of one)—this can be thought of as a base payout and the payout amount can be indicated on the display 240. Option 2 is associated with two multiplier payouts, namely "×2" (times two) or "×3" (times three). Finally, option 3 is associated with a single multiplier payout, for example, selected from "×5" (times five) or "×10" (times ten). A multiplier payout can be considered a payout amount equal to the base payout multiplied by the multiplier. In this way, a "×2" multiplier payout is an award equal to twice the base award.

Figure 7A:
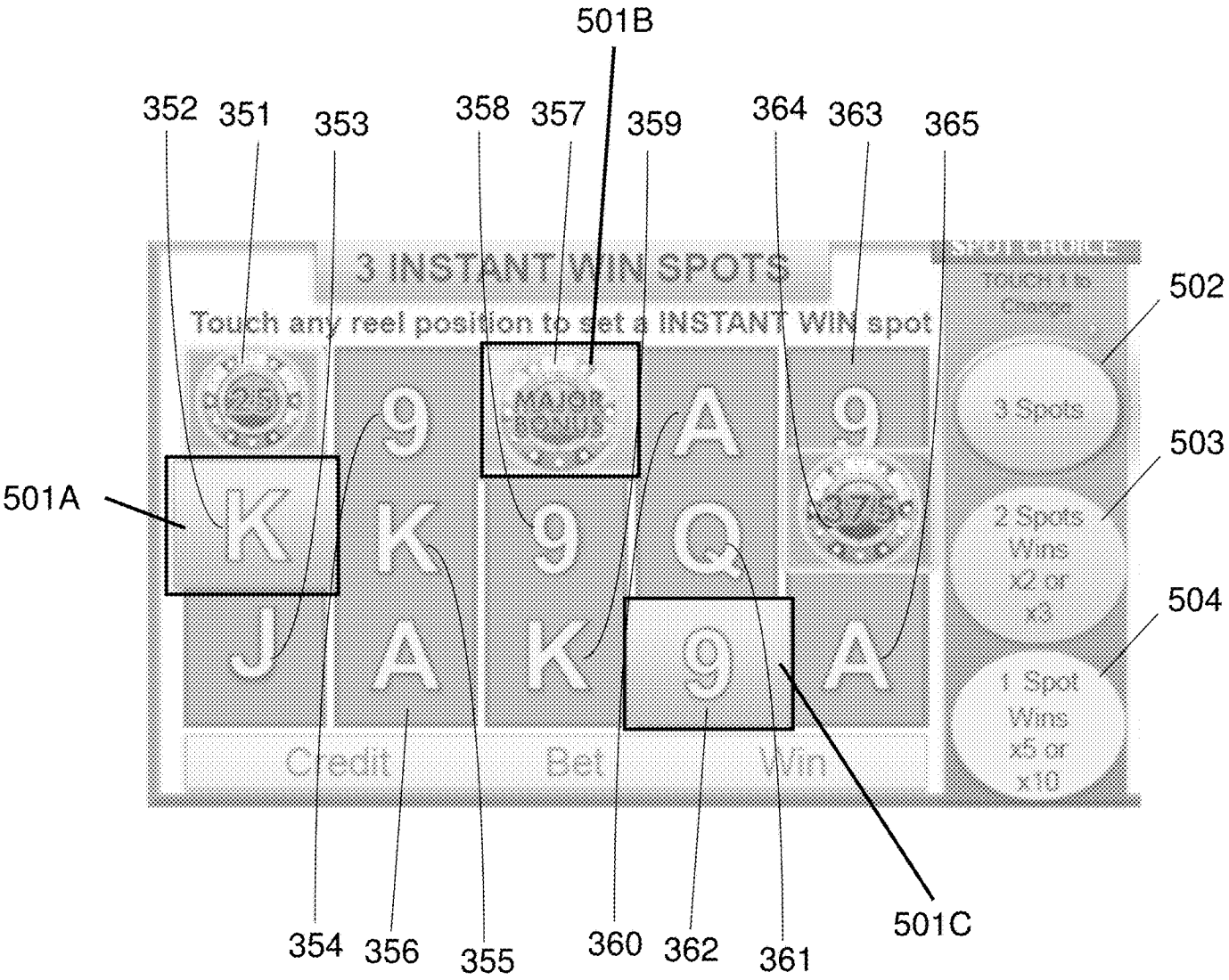
FIGS. 7A, 7B, and 7C show different configurations of the Cash-on-Reel base game.
Figure 7B:
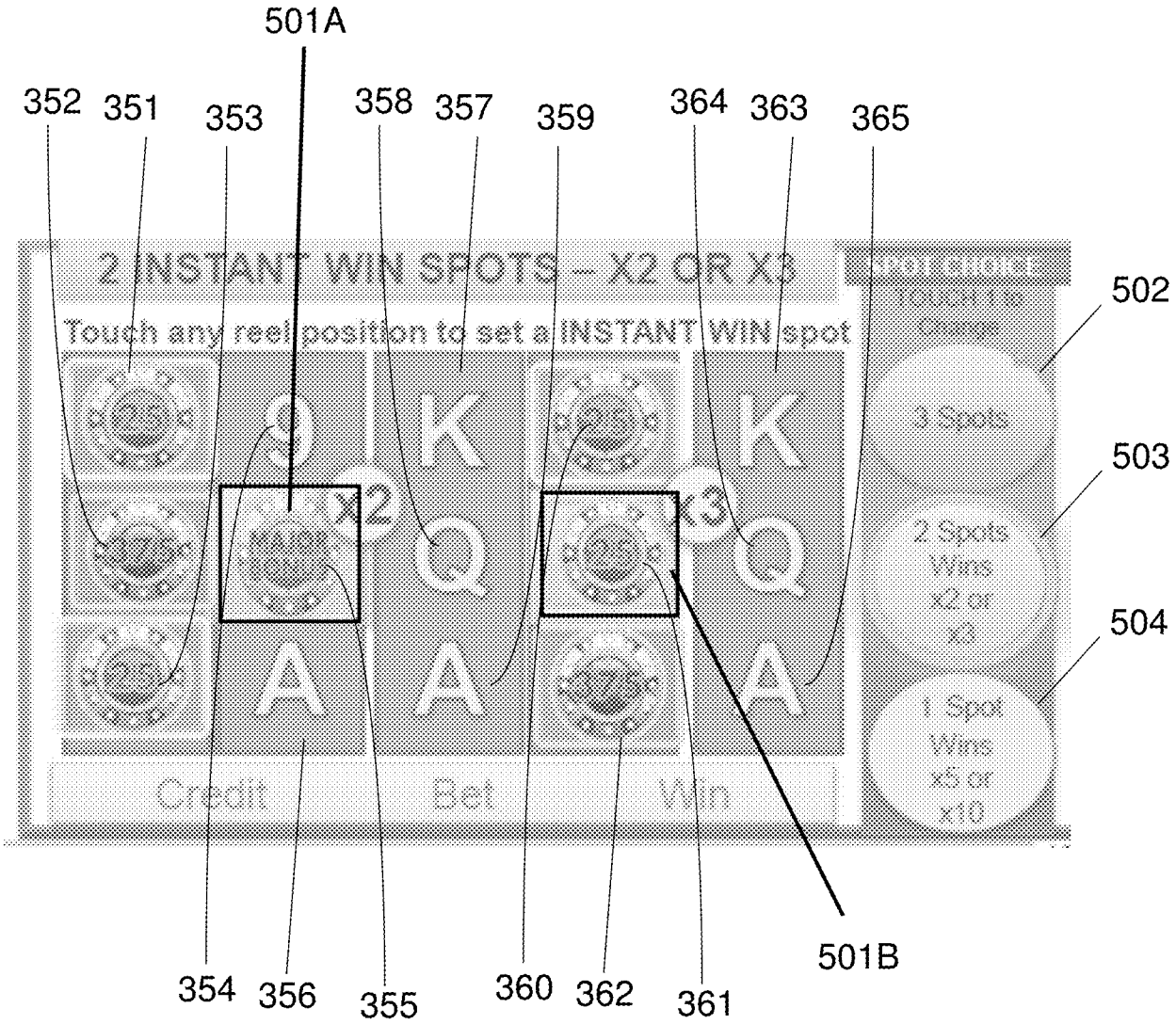
Figure 7C:
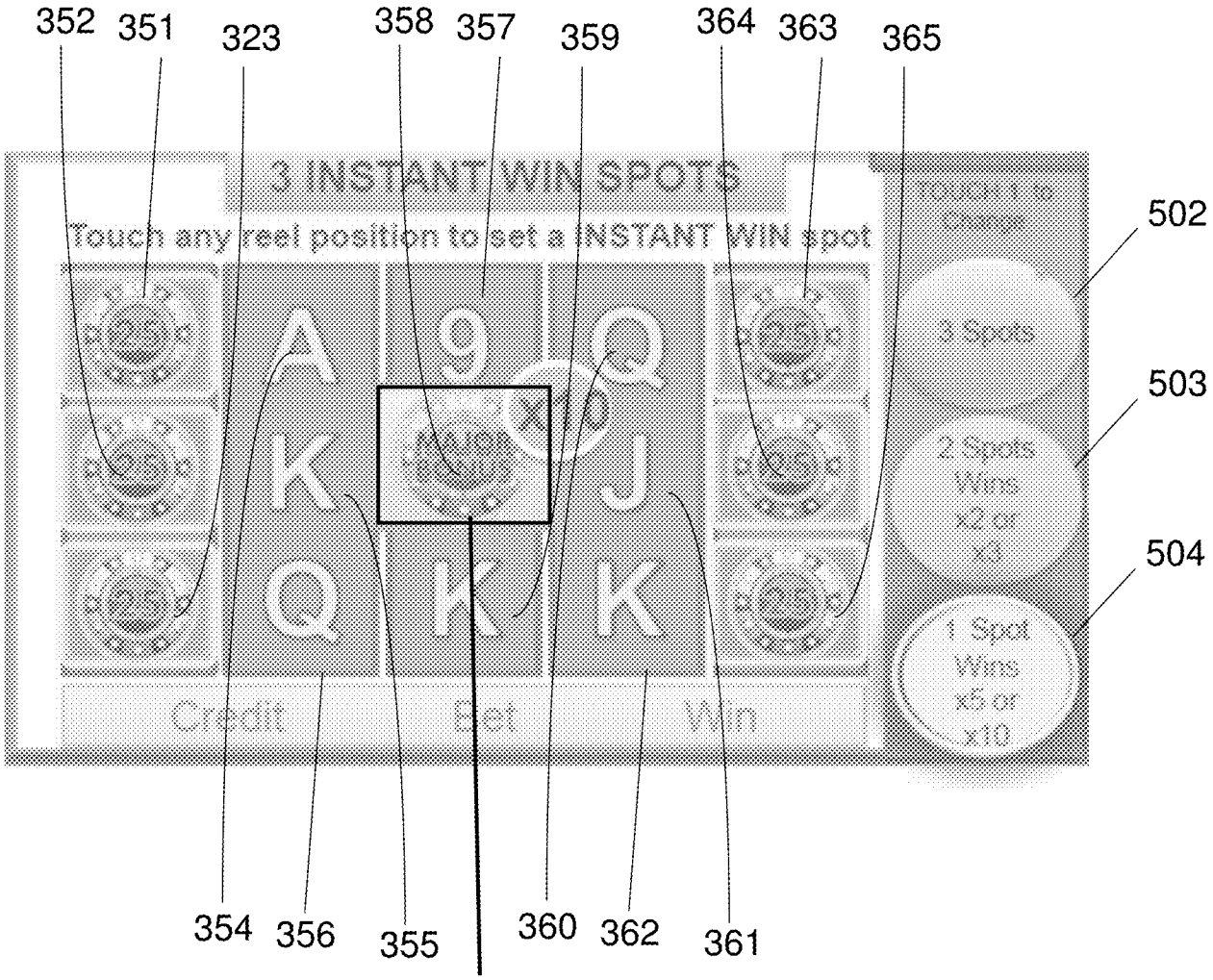

In an embodiment, the player configures the COR base game by selecting (e.g., pressing via a touchscreen interface of primary game display 240) one of the three buttons 502, 503, 504. The number of "SPOT(s)" corresponds to a selection number, being a number of COR symbol window(s) 501 that will be utilized for the COR game 500. FIG. 7A shows three selected COR symbol windows 501A, 501B, 501C (hence, 3 SPOTS) corresponding to symbol positions 352, 357, 362 and are illustrated with bold borders around each selected symbol position 352, 357, 362. FIG. 7B shows two selected COR symbol windows 501A, 501B (hence, 2 SPOTS) corresponding to positions 355, 361, and are illustrated with bold borders around each selected positions 355, 361. FIG. 7C shows one COR symbol window 501A (hence, 1 SPOT) corresponding to position 354 (illustrated with a bold border).

In an embodiment, the player selects the COR symbol window(s) 501 (e.g., as shown by 501A, 501B, and/or 501C as described above with respect to FIGS. 7A-7C) by touching the primary display 240 (being a touchscreen) within one or more desired windows of the displayed symbol positions 351-365. A COR symbol window can be displayed visually to the player using a variety of graphical indications, including one or more of: (a) changing the color of the window to highlight the distinction between a symbol position associated with the selected COR symbol windows; (b) displaying a visually identifiable border around the selected window; (c) altering the wording or graphical content of the symbol position displayed within the COR window; and/or (d) altering the size of the symbol position within the COR window (e.g., by slightly enlarging the symbol position in a manner that aids in indicating the presence of the selected COR window without interfering with the visual perception of adjacent symbol positions). In the embodiments of FIG. 7A-7C, for example, the colors of the symbol positions associated with the selected COR windows are altered and a visually perceptible border is displayed. As will be explained in more detail below, if a game play results in a COR symbol being within one of the selected COR window(s), an award rule is applied to provide a corresponding award to the player.

In another embodiment, the player configures the COR base game by selecting and deselecting (e.g., pressing on "deselected" or "selected", respectively) the number of COR symbol windows 501 desired—the gaming device 200 then determines an associated option in accordance with the number of COR symbol windows 501 selected.

In some embodiments, for options associated with a plurality of multipliers (or more generally, a plurality of different awards), for example options 2 and 3 described above, one of the plurality of multipliers is selected randomly and associated with all COR symbol windows 501—therefore, the same multiplier is associated with all COR symbol windows 501. In other embodiments, each COR symbol window 501 is randomly associated with a multiplier from the plurality—therefore, different COR symbol windows 501 may be associated with different multipliers. In both embodiments, the particular multiplier (or more generally a particular award) associated with the COR symbol windows 501 may be reselected between plays of the COR base game.

Generally, the COR symbol window(s) 501 can be associated with a distinct visual element (such as the borders shown in the figures). The visual elements can include modification to the overall appearance of the selected symbol position(s) 351-365 associated with the corresponding window and/or the symbol displayed in the selected symbol position(s) 351-365. In the latter case, the symbols can be highlighted or otherwise visually enhanced.

Figure 6:
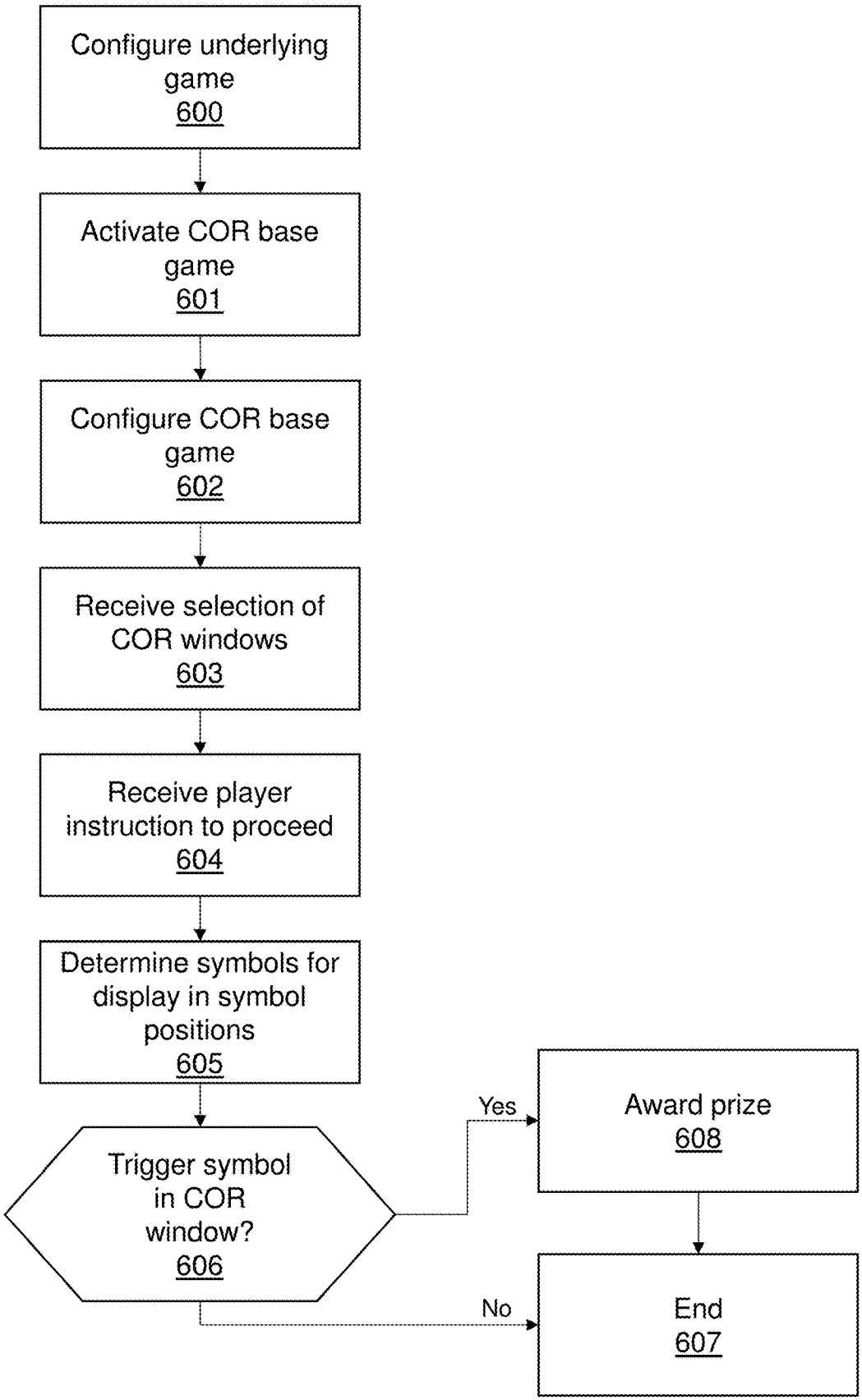
FIG. 6 shows a method for playing the Cash-on-Reel base game of FIG. 5.

A method for playing the COR base game according to an embodiment is shown in FIG. 6. Generally, the COR base game is played in conjunction with the underlying reel game. The gaming device 200 is put into a pregame configuration mode, at step 600. The pregame configuration mode enables the player to configure the COR base game and typically also the reel game, before gameplay.

At step 600, the player is optionally enabled to select a configuration of the reel game. The configuration can include, for example, an amount wagered and a number of lines per play. In this sense, the base game is configured according to known techniques.

At step 601, the player is enabled to activate a COR base game. For example, the player may interact with the gaming device 200 via touchscreen of primary display 240 and/or buttons 236. In another embodiment, the COR base game is automatically activated (e.g., it is always played during gameplay on the gaming device 200).

At step 602, the player is enabled to configure the COR base game by selecting a number of "SPOT(s)" (e.g., a number of COR symbol windows 501) that will be utilized during the COR base game.

At step 603, the gaming device 200 then receives, via a user input, a selection of COR symbol windows 501 equal to the number of desired COR symbol windows 501—for example, FIGS. 502-504 show selection of three, two, or one COR symbol window(s) 501, respectively. As an alternative to steps 602 and 603, the COR base game is automatically configured to select a pre-determined number of SPOTS and/or a pre-determined number of COR symbol windows 501. In one example, 5 symbol positions making up a middle row of a 3×5 symbol matrix are automatically configured to be selected as COR symbol windows. Optionally, the player may be given an option to change the automatic selection.

The gaming device 200 then receives, at step 604, a player instruction to proceed with game play, and responsive to the player instruction causes the processor to select, at step 605, using a random or pseudo-random process, symbols for display in symbol positions 351-365 within the display matrix. The method used to select the symbols can be that described with reference to FIG. 4. Therefore, for each symbol position 351-365 in a particular column, the selected symbols are obtained from the corresponding reel strip 321-325. It is envisaged that alternative methods may be utilized for selecting symbols for display in symbol positions 351-365.

The, or each, COR symbol window 501 is checked, at step 606, as to whether a COR symbol is associated with the COR symbol window 501—the presence of a COR symbol in a COR symbol window 501 corresponds to a "win event". If the gaming device 200 determines that no win event has occurred, it proceeds to end game step 607. Typically, the win event is separate to any winnings that may be applicable in respect of the base game 500.

If the gaming device 200 determines that one or more win events have occurred, the method proceeds to step 608 to award an award. As described previously, a COR symbol is associated with a processor-configurable award amount. The gaming device 200 then awards the associated award to the player (for example, by making a credit).

The method then proceeds to end game step 607. The end game step 607 can be followed immediately by a return to step 600. More generally, the player may observe a seamless transition to another round of play. At this stage, the player may be provided with the option of reconfiguring and/or reselecting the COR base game before another play (see steps 600-602) or to simply proceed with another round of gameplay (see step 603) without reconfiguration—that is, the previous configuration of a number of COR symbol window(s) 501 can be utilized for the next play of the game or a new configuration may be selected.

Figure 8:
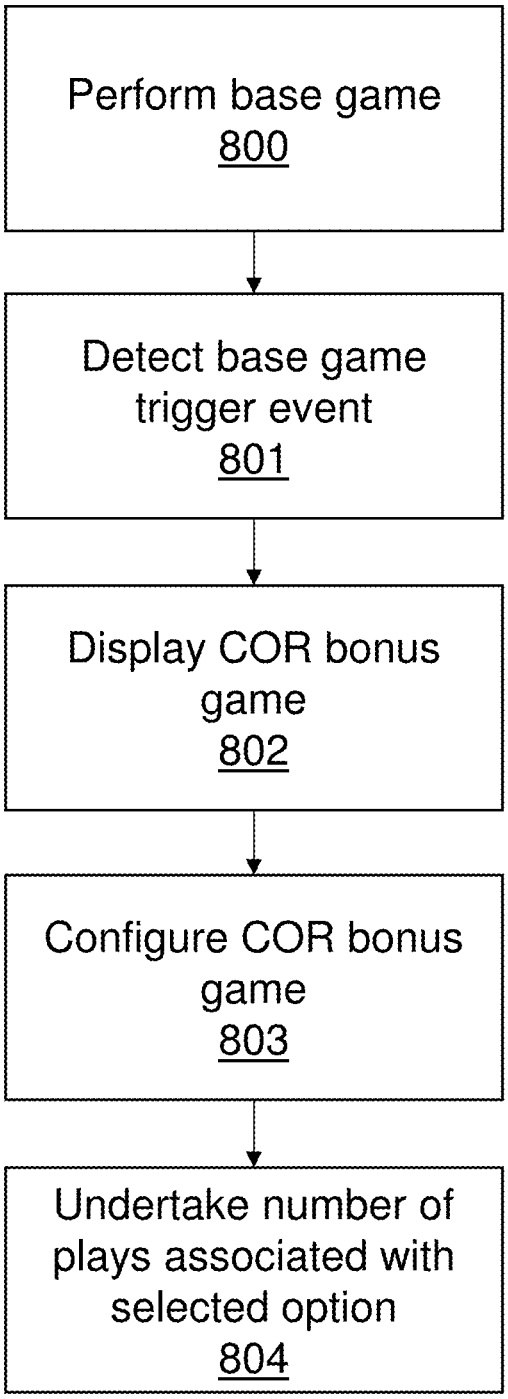
FIG. 8 shows a Cash-on-Reel bonus game according to an embodiment.

A method for playing a COR bonus game according to some embodiments is shown in FIG. 8. A game instance of a base game is performed at step 800. Generally, the base game includes a bonus game trigger event which occurs when a particular game result (or results) are present. In an example, the presence and/or arrangement of particular symbols in a spinning reel game may correspond to the trigger event.

In an embodiment, the base game corresponds to the COR game described with reference to FIG. 5. The presence of a predetermined number of trigger symbols (in this example, the COR symbols) in a base game result (e.g. three or more trigger symbols) constitutes the bonus game trigger event.

Figure 9A:
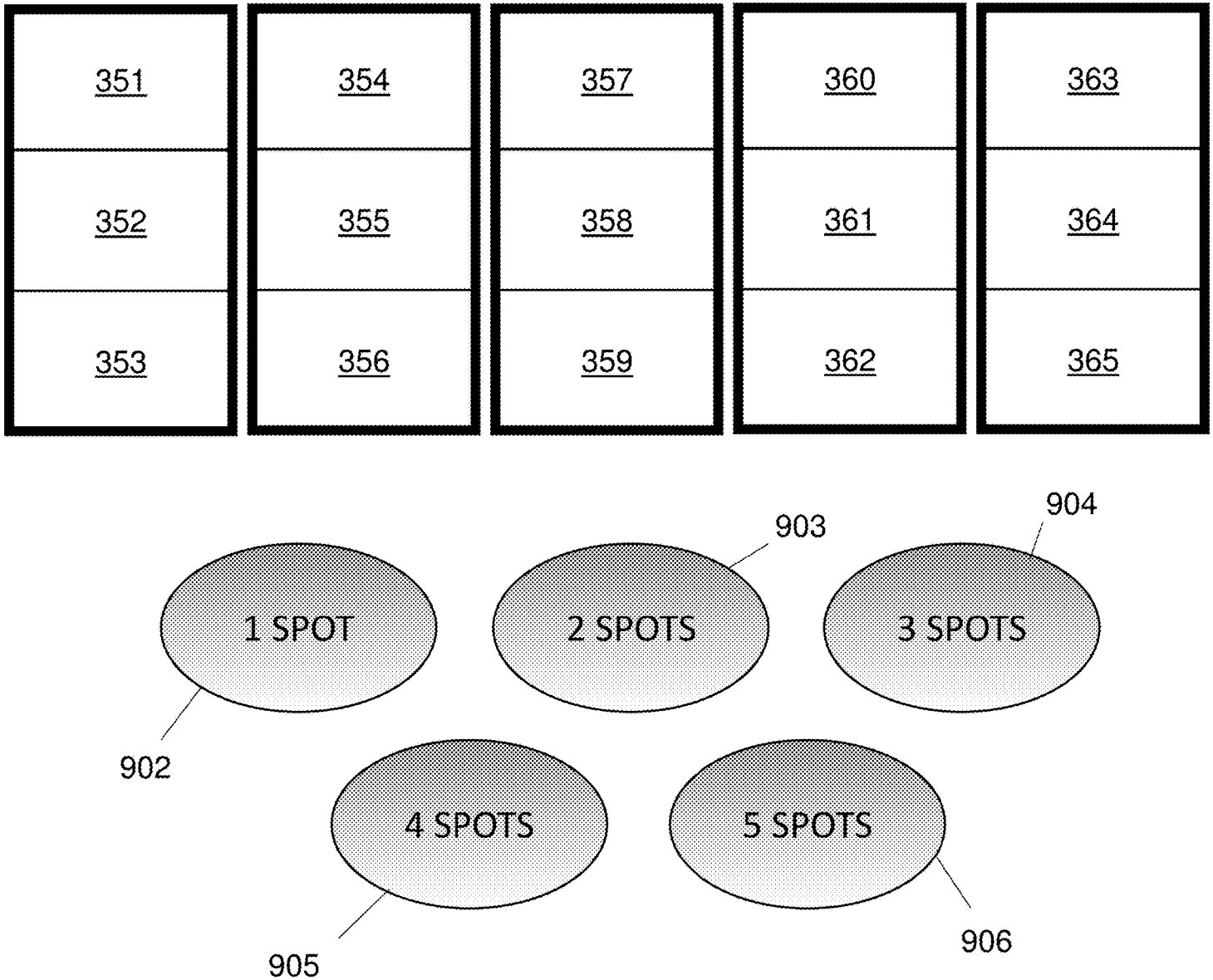
FIGS. 9A and 9B illustrate a method for playing the Cash-on-Reel bonus game of FIG. 8.
Figure 9B:
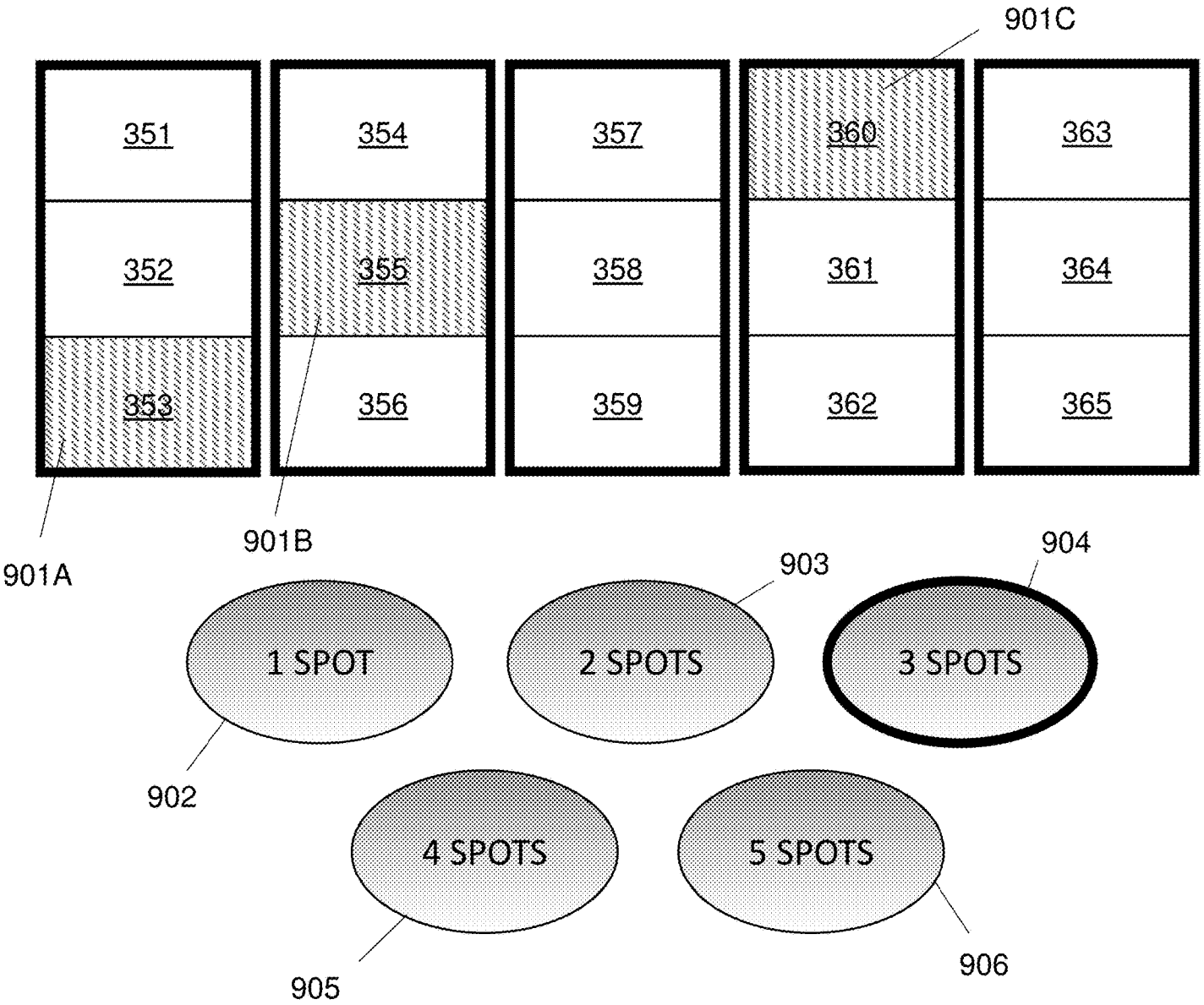

Upon detecting the trigger event at step 801, the gaming device 200 presents on its display 240 a COR bonus game initial screen 900, at step 802. FIGS. 9A and 9B show an example of the initial screen according to different embodiments. The COR bonus game comprises a spinning reel game 900 including five reel strips 321-325. Selected symbols from each reel strip 321-325 are displayed in associated symbol positions 351-365. The symbol positions 351-365 are arranged into three rows and five columns, as shown. Each symbol position 351-365 corresponds to a symbol display position, such that, after play of a game, symbol positions 351-365 comprise symbols selected from the five reel strips 321-325 (see, for example, the method of FIG. 4). The embodiments described herein are illustrative; the number of reel strips 321-325 and/or the number of symbol positions 351-365 can be varied as desired.

The COR bonus game is configured by the player before first play of the bonus game, at step 803. In the example shown FIG. 9A, the player is presented with five configuration options for selection: "1 SPOT" indicated by button 902 (option 1); "2 SPOTS" indicated by button 903 (option 2); "3 SPOTS" indicated by button 904 (option 3); "4 SPOTS" indicated by button 905 (option 4); "5 SPOTS" indicated by button 906 (option 5). Each option is associated with a number of plays of the COR bonus game and a number of one or more COR symbol windows 901 (e.g., shown as windows 901A, 901B, and 901C in FIG. 9B) selectable by the player (equal to the number of "SPOT(s)" associated with the option). Generally, the number of plays is smaller for an option having a higher number of SPOT(s). For example, option 1 can be associated with 30 plays, option 2 can be associated with 15 plays, option 3 can be associated with 10 plays, option 2 can be associated with 6 plays, and option 5 can be associated with 3 plays.

In this embodiment, step 802 corresponds to the player selecting an option by pressing (e.g. via a touchscreen interface of primary game display 240) one of the five buttons 902, 903, 904, 905, 906.

FIG. 9B shows an example of the COR game 900 configured with three SPOTS—see COR windows 901A, 901B, 901C.

Alternatively, in an embodiment, the COR bonus game is configured at least partially by the gaming device 200 before first play of the bonus game, at step 802. For example, the number of SPOTs is determined by the gaming device as being equal to a predetermined number, such as the three shown. Also, the windows 351-365 corresponding to COR symbol windows 901 (such as 901A, 901B, and 901C) may be predetermined.

Referring back to FIG. 8, the method then proceeds undertaking play of the spinning reel bonus game 900 a number of times equal to the number of plays associated with the selected option, at step 804.

A play of the spinning reel bonus game 900 includes the gaming device 200 receiving a player instruction to proceed with game play, and responsive to the player instruction causing the processor to select, using a random or pseudo-random process, symbols for display in symbol positions 351-365. The method used to select the symbols can be that described with reference to FIG. 4. Therefore, for each symbol position 351-365, the selected symbols are obtained from the corresponding reel strip 321-325. It is envisaged that alternative methods may be utilized for selecting symbols for display in symbol positions 351-365.

The, or each, COR symbol window 901 (e.g., COR symbol windows 901A, 901B, and 901C) is checked as to whether a COR symbol is present in the COR symbol window 901—the presence of a symbol in a COR symbol window 901 corresponds to a "win event". If the method determines that no win event has occurred, the round of play is complete.

If one or more win events have occurred, then an award is made, such as in accordance with step 608. The award may depend on the number of COR symbols present within COR symbol windows 901.

While the disclosed technology has been described with respect to the figures, it will be appreciated that many modifications and changes may be made by those skilled in the art without departing from the spirit of the invention. Any variation and derivation from the above description and figures are included in the scope of the present invention as defined by the claims. For example, reference to "base game" and "bonus game" is made for convenience of description—the embodiments described herein may be implemented as any suitable gaming option.

What is claimed is:

1. A system for controlling a user interface of an electronic gaming device having a display, the system comprising:

one or more processors; and memory storing instructions which, when executed by the one or more processors, cause the one or more processors to perform operations comprising:

receiving a selection, from among multiple selection options, of a number of windows among an arrangement of windows to be displayed by the electronic gaming device, wherein two or more of the multiple selection options offer different numbers of windows and different adjustments dependent on associated number of windows to maintain a target level of return to player (RTP) while providing different levels of volatility;

determining one or more of the windows of the arrangement to be checked for an award, wherein the one or more of the windows to be checked are equal in count to the number of windows associated with the selection of the number of windows;

undertaking play of a game, wherein, as a result of the play of the game, each window of the arrangement of windows is associated with a symbol to be displayed within that window, including randomly selecting symbols to be displayed within the windows of the arrangement from first symbols and second symbols;

for each of the one or more of the windows to be checked, checking whether a window encloses one of the first symbols; and awarding the award in accordance with how many of the one or more of the windows to be checked encloses one of the first symbols, the award further depending on an adjustment associated with the selection of the number of windows.

2. The system of claim 1, wherein the different adjustments are different multipliers for different ones of the multiple selection options, the different multipliers increasing as the associated number of windows decreases for the different ones of the multiple selection options, so as to maintain the target level of RTP while providing the different levels of volatility.

3. The system of claim 2, wherein at least some of the different multipliers are different dynamic multipliers, and wherein one of the different dynamic multipliers is randomly selected from multiple possible multipliers for a given one of the multiple selection options.

4. The system of claim 1, wherein the different adjustments are different reel strips for different ones of the multiple selection options, the different reel strips varying depending on the associated number of windows for the different ones of the multiple selection options, so as to maintain the target level of RTP while providing the different levels of volatility.

5. The system of claim 1, wherein the different adjustments are different lookup tables for different ones of the multiple selection options, the different lookup tables varying depending on the associated number of windows for the different ones of the multiple selection options, so as to maintain the target level of RTP while providing the different levels of volatility.

6. The system of claim 1, wherein the different adjustments are different amounts for the first symbols for different ones of the multiple selection options, the different amounts for the first symbols varying depending on the associated number of windows for the different ones of the multiple selection options, so as to maintain the target level of RTP while providing the different levels of volatility.

7. The system of claim 1, wherein the windows of the arrangement are organized by reel and by column, and the randomly selecting the symbols uses a reel per column, the reel having an associated reel strip with at least one of the first symbols and at least one of the second symbols.

8. The system of claim 1, wherein the operations further comprise:

receiving a selection of position of the one or more of the windows of the arrangement to be checked, wherein the determining the one or more of the windows of the arrangement to be checked depends on the selection of the position.

9. The system of claim 1, wherein the determining the one or more of the windows of the arrangement to be checked uses random selection of position of the one or more of the windows of the arrangement to be checked.

10. The system of claim 1, wherein the determining the one or more of the windows of the arrangement to be checked uses a predefined selection rule for position of the one or more of the windows of the arrangement to be checked.

11. The system of claim 1, wherein each of the multiple selection options offers a unique number of windows.

12. One or more computer-readable media having stored thereon computer-executable instructions for causing one or more processors, when programmed thereby, to perform operations to control a user interface of an electronic gaming device having a display, the operations comprising:

receiving user input indicating a selection, from among multiple selection options, of a number of windows among an arrangement of windows to be displayed by the electronic gaming device, wherein two or more of the multiple selection options offer different numbers of windows and different adjustments dependent on associated number of windows to maintain a target level of return to player (RTP) while providing different levels of volatility;

displaying a graphical indication of the selection of the number of windows;

displaying a result of a play of a game, wherein, as the result of the play of the game, each window of the arrangement of windows is associated with a symbol displayed within that window, symbols displayed within the windows of the arrangement having been randomly selected from first symbols and second symbols;

displaying a graphical indication of one or more of the windows of the arrangement checked for an award, wherein the one or more windows checked are equal in count to the number of windows associated with the selection of the number of windows; and displaying an indication of the award, wherein the award depends on how many of the one or more windows encloses one of the first symbols and further depends on an adjustment associated with the selection of the number of windows.

13. The one or more computer-readable media of claim 12, wherein the displaying the graphical indication of the selection of the number of windows includes enhancing a border around a graphical depiction of the selection of the number of windows.

14. The one or more computer-readable media of claim 12, wherein the displaying the graphical indication of the one or more of the windows of the arrangement checked for the award includes, starting before the displaying the result of the play of the game, for each of the one or more of the windows of the arrangement checked for the award, enhancing a border around a window, changing color of the window, altering wording or graphical content of the window, and/or altering size of the window.

15. The one or more computer-readable media of claim 12, wherein the displaying the graphical indication of the one or more of the windows of the arrangement checked for the award includes, for each of the one or more of the windows of the arrangement checked for the award, highlighting or otherwise visually enhancing the symbol displayed within the window.

16. The one or more computer-readable media of claim 12, wherein the different adjustments are:

different multipliers for different ones of the multiple selection options, the different multipliers increasing as the associated number of windows decreases for the different ones of the multiple selection options;

different reel strips for the different ones of the multiple selection options, the different reel strips varying depending on the associated number of windows for the different ones of the multiple selection options;

different lookup tables for the different ones of the multiple selection options, the different lookup tables varying depending on the associated number of windows for the different ones of the multiple selection options; or different amounts for the first symbols for the different ones of the multiple selection options, the different amounts for the first symbols varying depending on the associated number of windows for the different ones of the multiple selection options.

17. The one or more computer-readable media of claim 12, wherein the operations further comprise:

receiving user input indicating a selection of position of the one or more of the windows of the arrangement checked for the award.

18. A system for controlling a user interface of an electronic gaming device having a display, the system comprising:

one or more processors; and memory storing instructions which, when executed by the one or more processors, cause the one or more processors to perform operations comprising:

receiving an indication of a selection, from among multiple selection options, of a number of windows among an arrangement of windows to be displayed by the electronic gaming device, wherein two or more of the multiple selection options offer different numbers of windows and different numbers of game rounds dependent on associated number of windows to maintain a target level of return to player (RTP) while providing different levels of volatility;

determining one or more of the windows of the arrangement to be checked for an award, wherein the one or more windows to be checked are equal in count to the number of windows associated with the selection of the number of windows;

for each of the different numbers of game rounds associated with the selection of the different numbers of windows:

undertaking play of a game, wherein, as a result of the play of the game, each window of the arrangement of windows is associated with a symbol to be displayed within that window, including randomly selecting symbols to be displayed within the windows of the arrangement from first symbols and second symbols;

for each of the one or more windows to be checked, checking whether a window encloses one of the first symbols; and awarding the award in accordance with how many of the one or more windows to be checked encloses one of the first symbols.

19. The system of claim 18, wherein the different numbers of game rounds increase as the associated number of windows decreases for different ones of the multiple selection options, so as to maintain the target level of RTP while providing the different levels of volatility.

20. The system of claim 18, wherein the operations further comprise:

receiving a selection of position of the one or more of the windows of the arrangement to be checked, wherein the determining the one or more of the windows of the arrangement to be checked depends on the selection of the position.

* * * * *